United States Patent [19]

Sonneville

[11] 4,378,910

[45] Apr. 5, 1983

[54] ELASTICALLY YIELDABLE DEVICE FOR FIXING A RAIL ON A SUPPORT

[76] Inventor: Roger P. Sonneville, 1507 Gordon Cove Rd., Annapolis, Md. 21403

[21] Appl. No.: 290,055

[22] Filed: Aug. 4, 1981

Related U.S. Application Data

[63] Continuation-in-part of Ser. No. 179,880, Aug. 20, 1980, abandoned.

[30] Foreign Application Priority Data

Jun. 30, 1980 [FR] France ..... 80 14523

[51] Int. Cl.[3] ..... E01B 9/00; E01B 9/48

[52] U.S. Cl. ..... 238/349; 238/310

[58] Field of Search ..... 238/310, 315, 324, 321, 238/343, 349, 360

[56] References Cited

U.S. PATENT DOCUMENTS 3,970,248 7/1976 Molyneux ..... 238/249
4,109,860 8/1978 Serafin et al. ..... 238/349
4,312,477 1/1982 Hixson ..... 238/349
4,325,511 4/1982 Young ..... 238/349
4,327,865 5/1982 Greene ..... 238/349

*Primary Examiner*—Richard A. Bertsch
*Attorney, Agent, or Firm*—Wenderoth, Lind & Ponack

[57] ABSTRACT

The device comprises a spring fixed to a support at a point remote from the rail and curved in the direction of the rail, and a swing block interposed between the spring and the flange of the rail. The swing block bears against the flange of the rail at one end and against the support at its opposite end. The swing block is clamped by the end of the spring which applies a clamping force at point located at a distance from the flange of the rail but in the vicinity of the flange so that the two lever arms of the swing block have very different lengths. Further, the spring has a thickness which decreases in the direction of the rail and bears against the swing block by its end which is curved, the swing block having a corresponding shape under said end.

14 Claims, 8 Drawing Figures

FIG.1
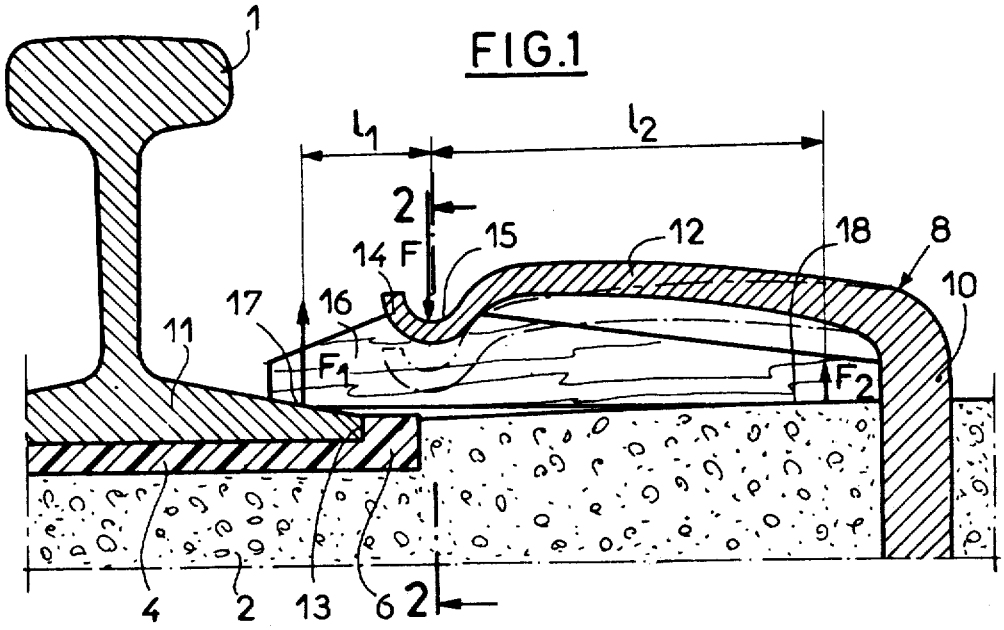
FIG.2
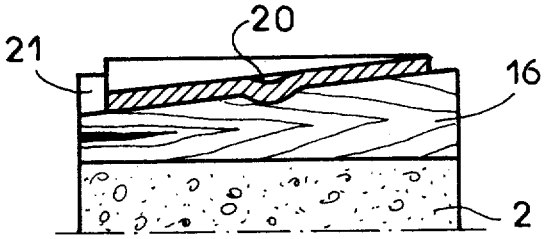
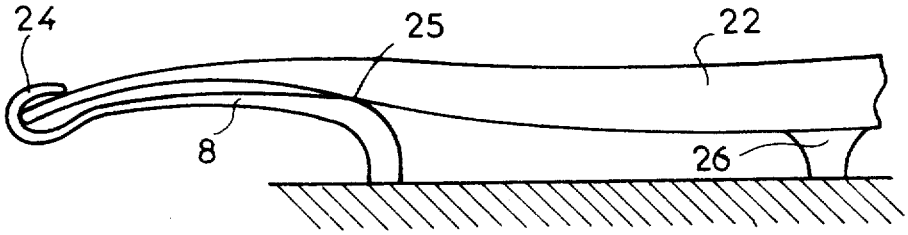
FIG.3

ELASTICALLY YIELDABLE DEVICE FOR FIXING A RAIL ON A SUPPORT

DESCRIPTION

This application is a Continuation-In-Part of U.S. application Ser. No. 179,880, filed Aug. 20, 1980, now abandoned.

The present invention relates to an elastically yieldable device for fixing a rail on its support, of the type comprising a spring which is put under stress between an anchoring member and the flange of the rail when mounting the rail and which thus exerts a clamping force on this flange without the use of bolts, screws or like means.

It is well known that the fixing devices of this type have the great advantage of avoiding the risk of excessive tightening and the risk of an accidental untightening. However, the use of these devices involves a serious drawback residing in the difficulty of placing the rail in its exact position on its support. Further, the spring and the anchoring member are metal components and it is usually necessary to interpose an insulating member between the rail flange and each of these components. Now, this insulating member is subjected to very severe working conditions since it is subjected to both high compression forces and wear resulting from the relative movements between the rail flange bearing on an elastically yieldable sole member and the anchoring member fixed to the support. Consequently, it is liable to deteriorate in a premature and dangerous manner.

In order to overcome this problem, there has been proposed a rail fixing device comprising a spring which is rigid with the support at one of its ends and is curved in the direction of the rail but does not reach the latter, and exerts a force on an intermediate member which bears against this rail. Such an arrangement enables the spring to be fixed previously and permanently, a long and narrow intermediate member being introduced under the spring and parallel to the rail after the installation of the latter between the rail and a lateral abutment.

However, this device does not permit obtaining a satisfactory distribution of the forces or a sufficient elasticity of the fixing.

An object of the present invention is consequently to provide an elastically yieldable rail fixing device which overcomes these drawbacks while it enables the rail to be easily and reliably placed in its exact position.

According to the invention, there is provided an elastically yieldable device for fixing a rail on a support comprising a spring which is rendered rigid with the support at one of the ends of the spring and is curved in the direction of the rail, the branch of the spring extending toward the rail having a length less than the distance between the curved portion of the spring and the flange of the rail and acting on an intermediate member which bears on the flange, wherein the spring has a thickness which gradually decreases in the direction of the rail, and a swing block which is highly asymmetrical bears at one end on the flange of the rail and at its opposite end on the support and which is clamped by the thin end of the spring at a points which is in the vicinity of the edge of the flange of the rail but outside the flange and spaced from the bearing point on the support, the lever arm between the point of application of the clamping force by the thin end of the spring and the bearing point on the flange of the rail being thus distinctly shorter than the other lever arm.

According to a preferred embodiment, the swing block has, in its upper part, a curved surface which has a shape corresponding to that of the thin end portion of the spring so that these two members can pivot relative to each other about a horizontal axis when the rail moves. The risks of premature and dangerous wear are thus practically eliminated.

The ensuing description of embodiments, given solely by way of examples and shown in the accompanying drawings, will bring out the advantages and features of the invention.

In the drawing:

FIG. 1 is a sectional view of an elastically yieldable device for fixing a rail according to the invention;

FIG. 2 is a sectional view taken on line 2—2 of FIG. 1;

FIG. 3 is a diagrammatic view illustrating a means for putting a spring under tension according to the invention;

Figure 4:
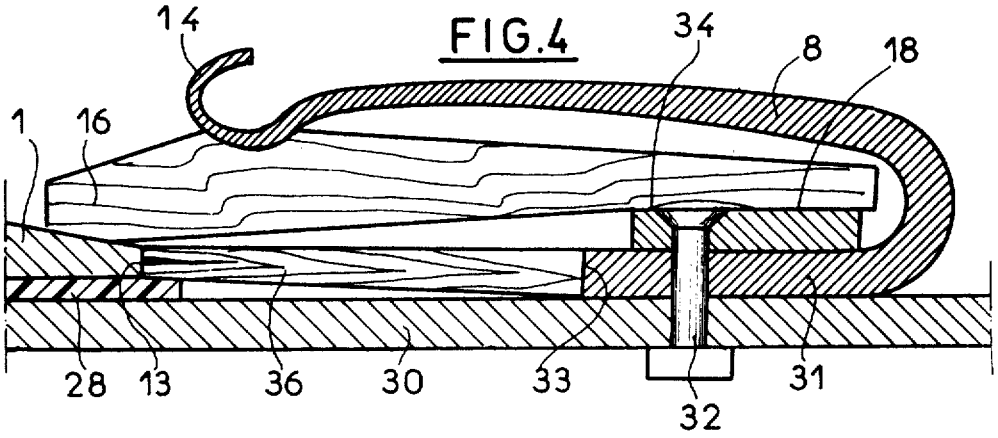
FIG. 4 is a sectional view, to an enlarged scale, of a modification of the device of FIG. 1.

As shown in FIG. 1, the device according to the invention is adapted to fix a rail 1 on a support 2 which is, for example, a concrete tie or sleeper, an elastically yieldable sole member 4 being interposed between the rail and its support. In the embodiment illustrated in FIG. 1, the elastically yieldable sole member 4 comprises two lateral ledges 6 which are adapted to perform the function of lateral abutments for the rail so as to maintain the correct spacing of the rails of the track and the unit comprising the sole member 4 with its ledges 6 is placed in a recess in the support 2.

At a relatively large distance from the ledge 6, i.e. at a distance of about 10 cm at the minimum, there is embedded a spring steel strip 8 which comprises a branch 10 which is substantially perpendicular to the upper side of the support 2 and is embedded in the latter. Outside this support, the strip 8 is curved in the form of a swan neck so as to form a second branch or arm 12 which is substantially horizontal and extends toward the flange of the rail 1. The length of the branch 12 is however less than the distance between the branch 10 and the flange 11 of the rail so that its end is set back relative to the vertical from the vertical side 13 of this flange 11. The branch 12 moreover has a thickness which progressively decreases in the direction toward the rail 1. For example, the maximum thickness of the spring strip 8, i.e. the thickness of the embedded branch 10, may be of the order of 10 to 15 mm and its minimum thickness, i.e. the thickness of the free end portion 14 of the branch 12, is of the order of 4 to 5 mm. The spring thus has a thickness which varies as a function of the bending moment to which it is subjected and constitutes a spring having a substantially constant bending strength. Consequently, for a given weight of steel, it exerts both the maximum force and has the maximum flexibility.

The thin end portion 14 of the branch 12 bears on the upper side of a swing or compensating block 16 which bears at one end 17 on the flange 11 of the rail and at its other end 18 on the support 2 in the vicinity of the embedded branch 10 of the spring. The bearing points 17 and 18 are located on each side of the vertical from the point 15 of application on the block 16 of the clamping force F exerted by the spring 8, at distances from said vertical which are distinctly different. Consequently, the lever arm $1_1$ between the bearing point on the flange of the rail and the point of application of the clamping force exerted by the spring is much shorter (about one quarter and even less) than the lever arm $1_2$ between the same point of application 15 of the clamping force and the bearing point on the support of the rail so that there is good distribution of the clamping force on these two parts.

Preferably, the thin end portion 14 of the spring 8 is curved in such manner as to have a substantially part-cylindrical shape whereas the swing block 16 has a corresponding curved shape. In the embodiment illustrated in FIG. 1, the thin end portion 14 has a concavity facing the exterior and the block 16 has a recess having a similar radius. The block 16 is thus both guided and maintained relative to the spring 8 in the direction perpendicular to the rail which prevents it from turning relative to the rail, whereas it is capable of pivoting slightly relative to the end portion 14 and thus distributing the clamping force F on a sufficient area.

Preferably, the part-cylindrical end portion 18 of the spring 8 has a deformation or boss 20 (FIG. 2) which cooperates with a corresponding cavity formed in the part-cylindrical recess of the block 16 so as to prevent this sliding in a direction parallel to the rail 1.

The swing block 16 may be made from any suitable material and in particular from metal. However, when it is desirable to elastically insulate the spring 8 from the rail 1, this block is made from an elastically insulating material. Its thickness may then be sufficiently great to permit constructing it from a sheet material with as little use as possible of products derived from oil, such as resinified wood and/or plywood, or agglomerated fibres. The cooperation of the cylindrical surfaces of the block and the end portion 14 of the spring 8 enables the clamping force to be distributed over a sufficient area so that the pressure undergone by this block is compatible with such a material without necessity to reinforce it with a metal reinforcement or plate.

The number of component parts of the fixing device, and more particular of the metal parts, is thus limited and this reduces the total weight of the device and of course its cost.

The rail may be, moreover, exactly placed in position with no problem. Indeed, when mounting the rail, the spring 8 is first embedded in the tie 2 and the elasticity of the branch 12 tends to move it toward this tie 2 so that the cylindrical end portion 14 assumes the position shown in dot-dash lines in FIG. 1, i.e. a position close to the tie and the lateral ledge 6 of the elastically yieldable sole member 4 but short of the inner face of this lateral ledge. The rail 1 is then placed in position on the sole member 4 between the two lateral ledges 6 which guide it and adjust its position. The end portion 14 of the spring 8 must then be raised so as to permit the introduction of the swing block 16 by translation thereof in a direction parallel to the rail 1, then this end portion is made to bear on the block 16 in the position shown in full lines in FIG. 1. It will be clear that the elastic deformation of the spring 8 resulting from the passage of the end portion 14 from the initial position of rest indicated in dot-dash lines to the position of use indicated in full lines, determines the value of the clamping force exerted by this spring. The thickness and the shape of the swing block 16 are thus chosen in accordance with the desired clamping force.

The raising of the thin cylindrical portion 14 of the spring 8 so as to introduce the block 16 may be achieved by means of the block itself by giving to the recess 21 receiving the cylindrical end portion 14 inclined generatrices as shown in FIG. 2. In this case, this cylindrical end portion 14 has itself generatrices inclined at the same angle. This inclination is for example of the order of 10%. The swing block 16 is then introduced under the end portion 14 in the manner of a wedge and progressively raises the spring as it is shifted in a direction parallel to the rail. When the bars 20 enters the corresponding cavity in the recess 21 of the block 16, the spring has been raised to the desired extent for producing the desired clamping force.

It will be understood that, in some cases, it may be considered preferable to raise the spring by means of an outside machine placed on the rail or by means of a lever or a sufficiently long crow-bar, such as that shown at 22 in FIG. 3. The thin end portion of the spring 8 is then folded so as to form a hook 24 in which the end of the lever 22 may be fitted. This lever bears on the thickest end portion 25 of the branch 12 of the spring and raises this hook to an extent slightly greater than that required for obtaining the desired clamping force. The travel of the lever 22 may be limited, for example, by an abutment 26 which bears against the support 2 so as to avoid an excessive deformation of the spring 8. The block 6 is then easily introduced under the hook 24 which is released and allowed to bear on the block in the same way as the end portion 14.

Whatever the arrangement chosen for raising the end portion of the spring 8 and putting it under stress, the fixing device permits a precise and exact positioning of the rail next to the spring and then an effective clamping of this rail through the swing block 16.

It will be understood that this fixing device may be used just as effectively when the elastically yieldable sole member on which the rail bears does not have lateral ledges and in particular in the case where the support is formed by a steel sole member or plate, or by a flat metal tie or sleeper as shown in FIG. 4. In this case, the rail 1 is placed on a flat insulating sole member 28 which is placed on the surface of the flat support 30. Instead of being embedded in the concrete, the fixing branch of the spring 31 is maintained against the upper surface of the support by means of rivets or countersunk-head screws 32 and a metal counter plate 34 which maintain the branch 31 closely clamped against the support 30. A plate or slab 36, bearing at one end against the edge 13 of the flange of the rail 1 and at its other end against the edge 33 of the branch 31 of the spring, laterally maintains the rail in position. The length of this plate 36 measured in the direction perpendicular to the rail, not only exceeds the distance between the end edge 33 of the branch 31 and the thin end portion 14 of the spring, but is sufficient to ensure that the plate 36 can perform substantially the function of a connecting rod following the small vertical movements of the flange of the rail without any relative friction and wear, the bearing point on the end edge 33 of the spring then performing the function of a semi-articulation. In this embodiment, the swing block 16 bears at one end against the flange of the rail and at its opposite end against the counterplate 34 which is rigid with the support 30. The plate 36 is of a material which has a good resistance to compression and preferably electrically insulating.

Figure 5:
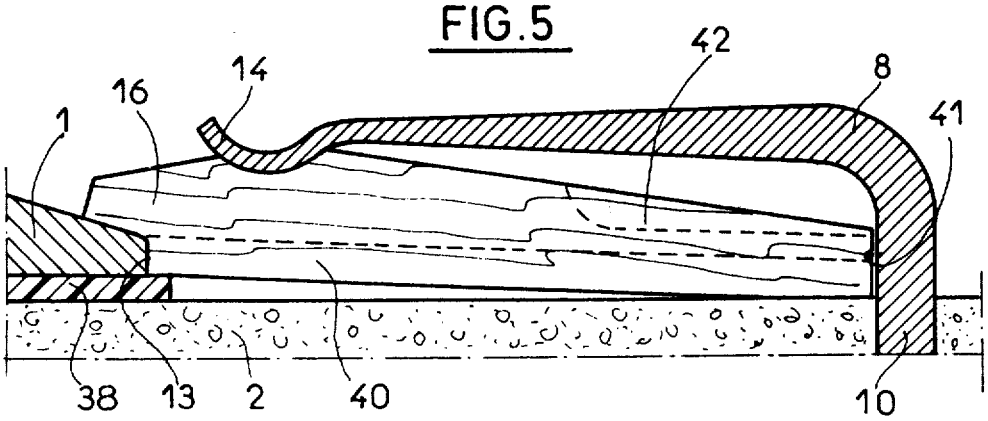
FIGS. 5 and 6 are views similar to FIG. 4 of two other embodiments of the device according to the invention.

A plate for laterally maintaining the rail may also be employed with a spring 8 embedded in a support of concrete as shown in FIG. 5. In the embodiment shown in this FIG. 5, the rail 1 is placed on a flat elastically yieldable sole member 38 which covers a part of the upper surface of the concrete support or tie 2. A lateral abutment plate 40 bears at one end, on one hand against the fixing branch 10 of the spring 8, and, on the other hand, against the concrete support 2 itself, and bears at its opposite end against the elastically yieldable sole member 38. This plate 40 determines the exact placement of the flange of the rail 1 and enables the rail to be installed before the swing block 16 is placed in position. However it may be in one piece with this swing block, which has the advantage of simplifying the construction and the assembly of the track while imparting to the assembly an improved strength and dielectric resistance. In the latter case, it is particularly advantageous to arrange that the lower part of the swing block and abutment plate member 16, 40 have square shape, the width of the block 16 in a direction parallel to the longitudinal axis of the rail being equal to the length of the plate 40, i.e. to the distance between the fixing branch 10 of the spring and the edge 13 of the rail flange. The combined member 16, 40 is then placed in position against the branch 10 which is initially perpendicular to its normal position of operation, i.e. in such manner that its thin end edge 41 is perpendicular to the branch 10 and extends from this branch to the desired position of the edge 13 of the rail flange. A cylindrical recess 42 formed in the upper surface of the block 16 in the vicinity of the end edge 41 receives the cylindrical end portion 14 of the spring 8 without raising it, i.e. in its lower position of rest, or by slightly raising it so as to hold it stationary during transport or handling.

When the rail 1 has been placed in its correct position owing to the guiding effect of the lateral face of the member 16, 40, this member is withdrawn by a translation thereof in a direction parallel to the rail and then turned through 90° about a vertical axis and re-inserted in such manner that its edge 41 is applied against the embedded branch 10 whereas its opposite end is applied against the edge of the rail flange, as shown in FIG. 5. In this position, the cylindrical end portion 14 of the spring is raised and exerts the desired clamping force.

It will be understood that the abutment of the thin edge 41 of the swing block 16 against the fixing branch 10 of the spring 8 may be replaced by an abutment against a shoulder of the support 2.

Figure 6:
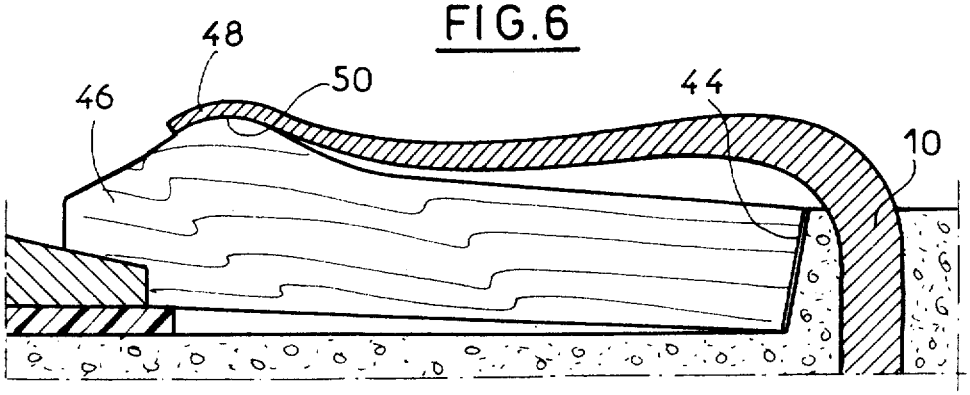

FIG. 6 shows an embodiment of this type in which a swing block 46, which also forms a lateral abutment plate, bears against a shoulder 44 of the support 2, the fixing branch 10 of the spring 8 being embedded in this support beyond this shoulder.

Likewise, the substantially cylindrical thin end portion of the spring 8 may have its concavity facing the support. Such an end portion 48 then cooperates with a corresponding surface boss 50 of the swing block 46 (FIG. 6).

According to another modification, which is particularly adapted to the fixing on a support comprising metal abutments for the rail and in particular on a metal sole of the type normally employed on wood sleepers which is provided with shoulders 60, the swing block may be installed before the rail and simply turned without being withdrawn for ensuring also automatically the stressing of the spring.

Figure 7:
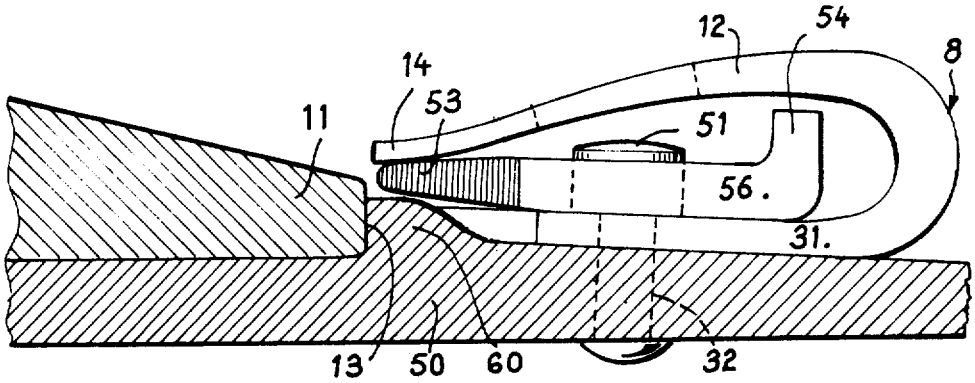
FIG. 7 is an elevational view of a device according to a modification before the rail is tightened down.
Figure 8:
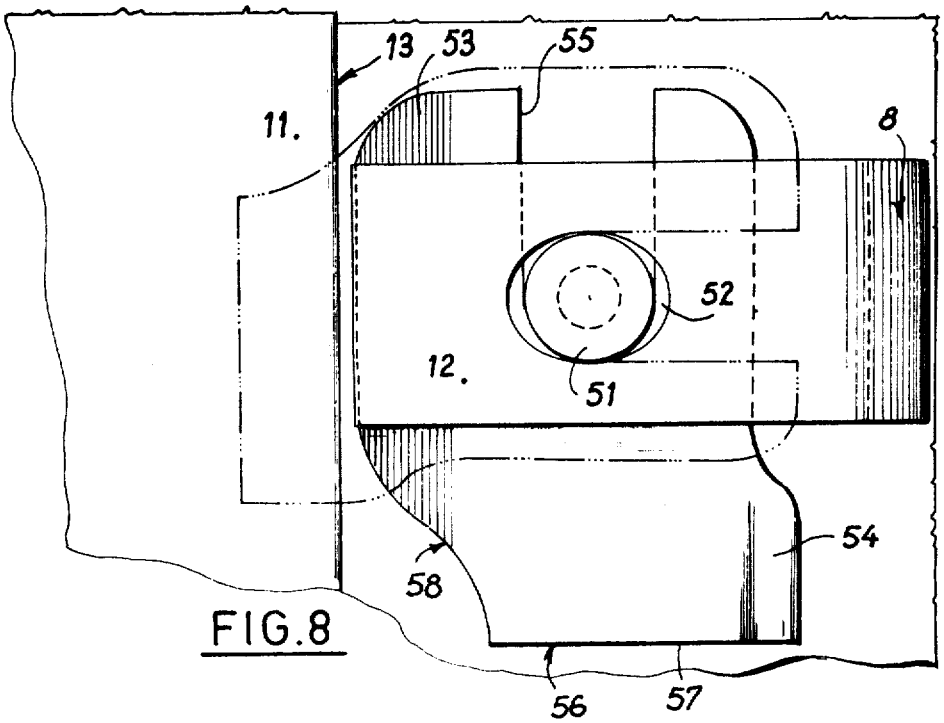
FIG. 8 is a plan view of the device of FIG. 7.

As shown in FIGS. 7 and 8, the spring 8 comprises then, in the same way as in the embodiment of FIG. 4, a fixing branch 31 which is maintained on the upper face of the sole 50 by means of a bolt or rivet 32. This rivet however has a forged head of cylindrical shape 51 projecting about the branch 31 whereas the flexible branch 12 of the spring is provided with an oblong aperture 52 permitting access to said head.

Before the mounting of the rail, a swing block 56 is introduced between the two branches of the spring 8 and disposed parallel to the direction of the rail 1 in a waiting position shown in full line in FIGS. 7 and 8. This swing block 56 comprises a longitudinal slot 55 whereby it can be fitted on the head 51 of the rivet. Further, one of its sides 53 is thinned down in the outward direction and in the direction of the rail in the illustrated waiting position and has substantially the shape of a wedge, whereas its other side carries at its thin end remote from the slot 55 a projection 54 which is forged and adjusted upwardly and preferably laterally offset (FIG. 8). In front of this projection, ie. at the offset end of the rectilinear end edge 57, the side 53 is preferably cut at 58.

When the rail has been placed in position against the abutment 60, a pressure or blows on the shoulder 54 is sufficient to turn the assembly of the swing block 56 around the head 51 in the clockwise direction as viewed in FIG. 8, so that its edge 57, offset from the slot 55, moves toward the flange 11 of the rail. In the course of this pivoting, the edge in the shape of a wedge 53 acts in the manner of a cam and progressively raises the free end 14 of the upper branch 12 of the spring 8 while the edge 57 slides along the part 11.

This spring 8 is stressed and the slot 55 passes under the flexible branch 12 in the vicinity of the curve of the spring 8. The rotation of the swing block 56 is limited to 90° by the abutment of the projection 54 against the edge of the spring 8. In this position, shown in dotted line in FIG. 8, the solid end 57 of the swing block is clamped against the flange 11 by the end 14 of the spring 8 while the end of the edge of the slot 55 bears on the support 50 through the branch 31.

In this embodiment, as in the foregoing embodiments, the clamping force F exerted by the spring has a component which is a reaction $F_1$ corresponding to the effective clamping force on the rail at 17, and a reaction $F_2$ at 18 on the support 2. It will be clear that the elastically yieldable fastening will improve with increase in the ratio between the lengths of the two lever arms of the swing block. Now, the working conditions of this block easily permit an increase in the length of the lever arm bearing on the support.

Further, the fact that the swing block can ensure the transmission to the rail of the major part of the clamping force exerted by the spring and the transmission to the support of the lateral forces exerted by the rail and possibly electric insulation of the rail from the spring, permits the construction of a fixing device having a very small number of component parts and consequently a cheap device apart from the fact that it is particularly effective and easy to place in position.

Having now described my invention what I claim as new and desire to secure by Letters Patent is:

1. An elastically yieldable device in combination with a rail and a support for fixing the rail on the support, said device comprising a spring which has a first branch rigid with the support at a first end of the spring, a bent portion and a second branch which is connected to the first branch by the bent portion and extends from the bent portion towards the rail, the second branch having a thickness which progressively decreases in the direction of the rail to a thin end portion of the spring adjacent a second end of the spring opposed to said first end thereof and a length less than a distance between the curved portion of the spring and the flange of the rail, and a compensating block which bears at one end of the block on the flange of the rail and at an opposite end of the block on the support and is clamped by the thin end portion of the spring at an intermediate point of the block in the vicinity of the edge of the flange of the rail but outside the rail.

2. A device as claimed in claim 1, comprising means defining an abutment for laterally maintaining the flange of the rail relative to the support.

3. A device as claimed in claim 2, wherein the lateral abutment for maintaining the rail comprises an abutment plate having a first end in abutting relation to the flange and a second end opposed to the first end of the plate and in abutting relation to a shoulder rigid with the support, the block being placed on said plate.

4. A device as claimed in claim 3, wherein the compensating block and the abutment plate for the flange of the rail are made in a single member and the abutment part of the member has a substantially square surface.

5. A device as claimed in claim 4, wherein the compensating block has in the upper surface thereof in the vicinity of a thinnest end edge of the block a recess of substantially part-cylindrical section which substantially matches the shape of the thin end portion of the spring so as to lock said thin end portion of the spring in a position of rest of the spring.

6. A device as claimed in claim 5, wherein the compensating block comprises a central slot for fitting on a cylindrical head of the rivet for maintaining the spring, a thinned down side in the form of a wedge and a projecting shoulder on the opposite side and pivots through 90° about the head of the rivet between a waiting position parallel to the rail and an active position perpendicular to the rail, the wedge performing the function of a cam and putting the spring under stress in the course of the pivoting thereof.

7. A device as claimed in claim 1, wherein the compensating block is highly dissymetrical, the distance between the point of application of the clamping force by the thin end portion of the spring and the bearing point of the block on the flange of the rail being distinctly shorter than the distance between the point of application of the clamping force by the thin end portion of the spring and the bearing point of the block on the support.

8. A device as claimed in claim 1, 2 or 7, wherein the thin end portion of the spring has a substantially part-cylindrical curved shape and cooperates with a portion of substantially matching shape on the upper surface of the block against which block the thin end portion bears.

9. A device as claimed in claim 8, wherein the generatrices of the part-cylindrical end portion of the spring and of the matching surface of the block are inclined relative to the horizontal so that the block constitutes a wedge for raising the end portion of the spring.

10. A device as claimed in claim 9, wherein the thin end portion of the spring is curved so as to form a hook for the insertion therein of a tool for raising the thin end portion of the spring.

11. A device as claimed in claim 1, 2 or 7, wherein the first branch of the spring extends in a direction parallel to the support and clamping means clamp the first branch against the support.

12. A device as claimed in claim 1, 2 or 7, wherein the compensating block is made from an insulating material.

13. A device as claimed in claim 12, wherein the insulating material is a resin-impregnated wood.

14. A device as claimed in claim 12, wherein the insulating material comprises fibres agglomerated by a resin.

* * * * *